US005100068A

United States Patent [19]

Pingel

[11] Patent Number: 5,100,068

[45] Date of Patent: Mar. 31, 1992

[54] ROLLER MILL

[75] Inventor: Herbert Pingel, Wadersloh, Fed. Rep. of Germany

[73] Assignee: Krupp Polysius AG, Fed. Rep. of Germany

[21] Appl. No.: 612,219

[22] Filed: Nov. 13, 1990

[30] Foreign Application Priority Data

Nov. 17, 1989 [DE] Fed. Rep. of Germany ..... 3938320

[51] Int. Cl.[5] ..... B02C 15/00

[52] U.S. Cl. ..... 241/121

[58] Field of Search ..... 241/285 R, 285 A, 285 B, 241/117-121

[56] References Cited

U.S. PATENT DOCUMENTS 4,225,093 9/1980 Rusch et al. ..... 241/285 R X 4,491,280 1/1985 Bacharach et al. ..... 241/121

4,572,442 2/1986 Sigg ..... 241/285 R X

*Primary Examiner*—Mark Rosenbaum

*Attorney, Agent, or Firm*—Learman & McCulloch

[57] ABSTRACT

A roller mill has a mill housing having a vertical axis. A coaxially aligned grinding track is arranged concentrically about the vertical axis and supports a plurality of grinding rolls. The mill housing is divided into a force-conducting housing part which absorbs horizontal grinding reaction forces and an air-ducting housing part which contains an air-ducting chamber and is mounted below the force-conducting housing part. The force-conducting housing part is supported on the foundation by supports. The air-ducting housing part is detachably secured to the force-conducting housing part and independently supported on the foundation by brackets and bearing supports.

14 Claims, 1 Drawing Sheet

ROLLER MILL

FIELD OF THE INVENTION

The invention relates to a roller mill with a mill housing having a vertical shaft, for grinding ores and minerals such as in the manufacture of cement materials.

BACKGROUND OF THE INVENTION

Roller mills of this type are well known in the art in various forms and are used for example for crushing ores and mineral materials, such as for example cement materials. In this case the material to be crushed is delivered to the grinding track and is crushed between this grinding track and the roller elements rolling thereon under pressure, and the crushed material is thrown off over the peripheral edge of the grinding track. The crushed material can be removed with the aid of an air current delivered to the air ducting chamber and separated and/or—in the event of hot air being delivered—dried in the air current.

In the roller mills which are known in the art the mill housing is usually produced in the form of a welded sheet steel structure, and also in the form of a cast construction. In this case the mill housing must absorb both the forces of weight of the superstructure and also the horizontal (reaction) forces from the size reduction work (grinding process), these predominantly horizontal forces being largely conducted into the mill housing by mountings for the roller elements. These mill housings are generally ribbed and of complex construction, are erected on a foundation and have no clear flux of force. Thus in these known roller mills the mill housings evade an exact technical calculation of the reaction forces, with the result that such a mill housing is generally of heavier construction than it would need to be.

SUMMARY OF THE INVENTION

The object of the invention, therefore, is to provide a roller mill of the type for grinding granulated mineral materials into a sufficiently ground state. The roller mill apparatus comprises upper support means for supporting the force-conducting a grinding means, a mounting means for mounting the grinding means on a foundation, an air-ducting housing encircling the grinding means and forming an air-ducting chamber at a level below that of the grinding means, an air supply means communicating with the air-ducting chamber for delivering a stream of air to the air-ducting chamber, a support means for supporting the force-conducting housing on the foundation independently of the mounting means, and a force reaction means interconnecting the grinding means and the force-conducting housing for absorbing horizontal grinding reaction forces generated by the grinding means. The subject roller mill is distinguished in particular by a mill housing which is of relatively simple construction and is better adapted to the reaction forces to be expected as well as being relatively simple to install and maintain. The invention achieves these advantages by providing a support means for supporting the force-conducting housing independently of the mounting means, coupled with the force reaction means interconnecting the grinding means and the force-conducting housing for absorbing horizontal grinding reaction forces generated by the grinding means. In this manner, the vertical components of force of the grinding means is isolated from the horizontal components of force from the grinding means.

In this construction of the roller mill according to the invention there has been to some extent a division of functions, that is to say on the one hand into the conducting of the reaction forces, particularly horizontal ones, occurring during the crushing operation and also into the conducting or absorption of the corresponding weights, as well as on the other hand the ducting of the air to be fed into the mill housing or into the air ducting chamber. By dividing up the most important functions in the mill in this way the flux of force occurring during the crushing operation becomes recognisable and calculable. Thus the mill housing is divided at least into an upper force-conducting housing part and an air-ducting housing part arranged below it. In this case at least the force-conducting housing part is supported on the foundation by several supports.

This construction according to the invention leads in an advantageous manner to a mill housing which is adapted to the flux of force and leads to considerable savings of materials by comparison with the housings of the known comparable roller mills and thus in turn leads to considerable cost savings. Such a mill housing which is constructed according to the invention is adapted to the reaction forces and weights which occur and also permits particularly simple assembly of the entire roller mill. The invention also provides the possibility of replacing at least one housing part, particularly the force-conducting housing part, with a modular system for an entire series of mills.

THE DRAWINGS

The invention will be explained in greater detail below with the aid of the drawings. In these drawings.

DETAILED DESCRIPTION

Figure 1:
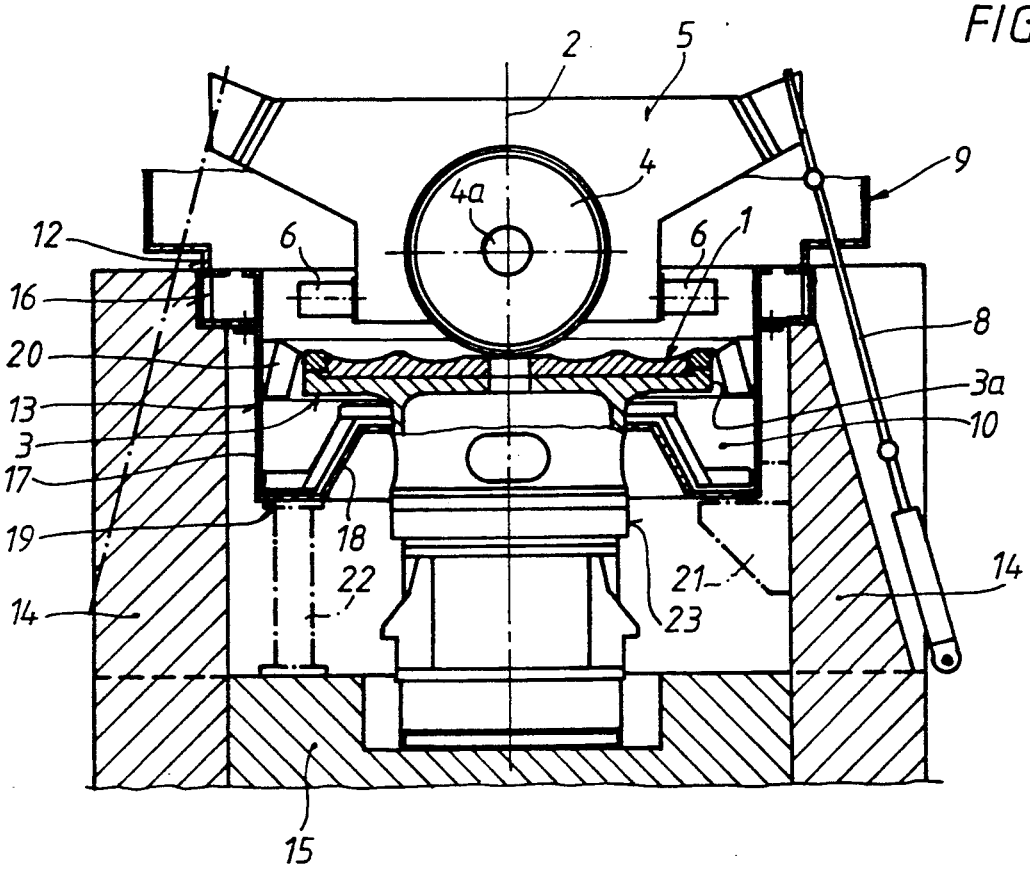
FIG. 1 shows a partially schematic vertical sectional view of the roller mill, approximately corresponding to the section line I—I in FIG. 2.

For this explanation of the roller mill according to the invention, an example is chosen in the drawings in which the roller mill is constructed in the form of a so-called roller grinding mill or spring-loaded roller mill. Although this embodiment of the roller mill is regarded as particularly advantageous for the construction of the mill housing, and thus preferred, it should be emphasised that the roller mill according to the invention and in particularly the construction according to the invention of the appertaining mill housing also applies in principle to so-called ring ball mills, ring roller mills or the like.

Figure 2:
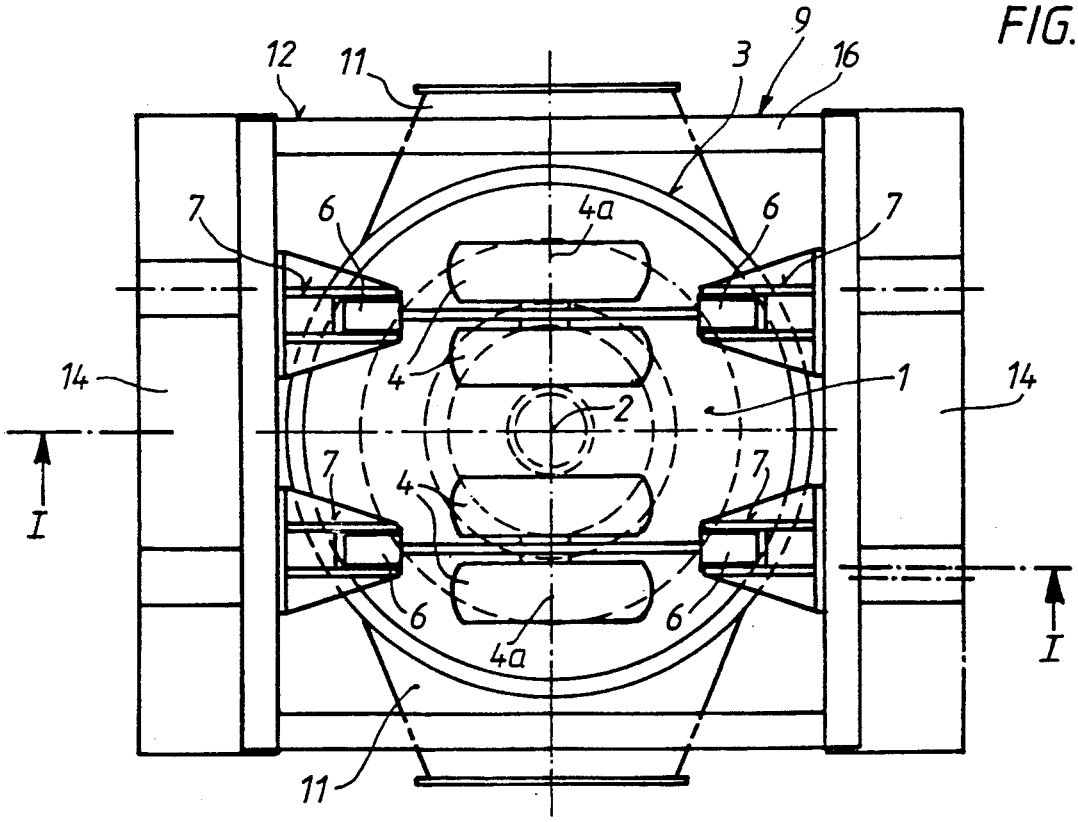
FIG. 2 shows a simplified plan view of the roller mill according to FIG. 1.

The roller grinding mill which is chosen as the mill is of the type in which a grinding track 1 is formed by the disk-shaped upper face of a grinding plate 3 which is driven so as to be rotatable and is arranged coaxially with respect to the vertical housing axis 2. The rolling elements in the form of grinding rollers 4 are distributed about the vertical housing axis 2 and held so as to freely rotatably roll under pressure. In the present case it may be assumed that—as shown in FIG. 2—four grinding rollers 4 are provided and are co-ordinated in two pairs of rollers which lie symmetrically opposite one another, as is known per se. The grinding rollers 4 are mounted so as to be freely rotatably movable about their axes of rotation 4*a* and are held on approximately vertically aligned retaining arrangements 5 which have on their opposing sides guide pins 6 which in their turn are guided in stationary vertical guides so as to be freely movable up and down. Thus the grinding rollers rest on the grinding track 1 under the pressure of their own weight and of the weight of the retaining arrangements 5, and tension rods 8 which are spring-loaded in the usual manner engage on the outer end sections of the retaining arrangements 5. A mounting means is provided for mounting the grinding plate 3 and the grinding rollers on a foundation 15. The mounting means includes a gear unit 23 resting upon the foundation 15, as shown in FIG. 1.

The grinding plate 3, the grinding rollers, their mountings 5 and the vertical guides 7 are arranged in a mill housing 9—which is only shown to the extent that it is necessary—and all these parts are provided coaxially or symmetrically with respect to the vertical axis 2 of this mill housing 9.

In the peripheral region of the grinding plate 3 and thus of the grinding track 1 an approximately annular air ducting chamber 10 is constructed to which air is delivered from any suitable source via at least one air supply means, or connection, 11; this can be separating and conveying air for the crushed feed material which is thrown off over the outer edge 3*a* of the grinding plate, and if required this air can also be hot air for drying the feed material.

The construction of the mill housing 9 is of particular importance. This mill housing 9 is preferably divided into at least two housing parts, namely an upper force-conducting housing part 12 and an air-ducting housing part 13 which is arranged below it. The force-conducting housing part 12 serves to absorb in particular the horizontal reaction or grinding forces (function: conducting the forces) as well as taking the weight of the parts supported by it (grinding tools, etc.), whilst the air-ducting housing part 13 (function: ducting the air supplied) defines the air ducting chamber 10 at the sides and at the bottom. The guide pins 6 and associated vertical guides 7 (FIG. 2) comprise a force reaction means interconnecting the grinding means, i.e., the grinding plate 3 and the grinding rollers 4, and the force-conducting housing 12 for absorbing horizontal grinding reaction forces generated by the grinding means. The air-ducting housing part 13 is mounted coaxially below the force-conducting housing part 12 and is in open communication with the latter. A support means is provided for supporting the force-conducting housing 12 on the foundation 15 independently of the mounting means. In the preferred embodiment, the force-conducting housing part 12 is supported on the foundation 15 by means of several supports 14. These supports can—as shown in the drawing—be two sufficiently long concrete pillars which lie opposite one another a suitable distance apart and symmetrically with respect to the housing axis 2 so that the lower end of the force-conducting housing part 12 is fixed at a suitable height on the upper ends of these pillars 14. Naturally, instead of concrete pillars steel supports which are suitably constructed and adapted could also be provided.

The force-conducting housing part 12 contains a force-conducting frame 16 which is polygonal in plan (cf. FIG. 2), preferably rectangular, and by means of which this upper housing part 12 is fixed on the supports 14, preferably screwed on by screws which are not shown in detail. In the illustrated embodiment the force-conducting frame 16 is constructed in the form of a sectional steel frame, that is to say a welded construction; it can be completely closed, but if required can also be constructed so as to be more or less open. This construction permits the use of steel profiles which can be accurately adapted to the particular requirements for the individual sections of this frame 16. Basically, however, it also possible to construct this force-conducting frame 16 as an accurately adapted cast construction.

What has been said above in connection with the construction of the force-conducting frame 16 also applies to the entire construction of the force-conducting housing part 12, which can be produced as a whole as a welded sheet steel construction or as a cast construction. In this connection it should also be mentioned that the force-conducting frame 16 as a whole forms or can form the essential part of the force-conducting housing part 12.

As has already been mentioned above, the retaining arrangements 5 for the grinding rollers 4 are guided by the guide pins 6 in the stationary vertical guides 7. These vertical guides 7 are—as can be seen in particular from FIG. 2—mounted on opposing inner sides of the force-conducting housing part 12. The aforementioned force-conducting frame 16 is also arranged approximately at the height at which the guide pins 6 of the retaining arrangements 5 are also located, i.e. the force-conducting frame 16 preferably lies at the same height as the guide pins 6 (as shown in FIG. 1), or the height of the force-conducting frame 16 relative to the grinding rollers 4 can be chosen so that—depending on the desired height of the frame 16 relative to the grinding rollers 4—the guide pins are arranged somewhat above or below the height position containing the guides pins 6. In any case, the height of the force-conducting frame 16 relative to the grinding rollers 4 or their retaining arrangements 5 and associated guide pins 6 is chosen so that a particularly favourable absorption of the horizontal reaction forces from the crushing process is provided in order above all to achieve an optimum housing construction as regards weight (material) and stability.

The stationary air-ducting housing part 13 which surrounds the grinding plate 3 and thus the grinding track 1 contains an outer peripheral wall 17 which is adapted approximately in its internal diameter to the internal cross-section of the force-conducting housing parts 12. The air-ducting housing 13 also includes an inner peripheral wall 18 which is arranged radially spaced from the outer peripheral wall and a base plate 19 which forms the lower closure of this housing part 12. As shown in FIG. 1, the base plate 19 is fixed on the lower peripheral edges of the two peripheral walls 17, 18 and preferably arranged approximately horizontally and constructed in annular form.

As can be seen from FIG. 2, in the illustrated embodiment two diametrally opposing air supply connections 11 are provided. These two air supply connections 11 are connected to the outer peripheral wall 17 in the height region between the base plate 19 and the grinding plate 3 or the grinding track 1. In this case these air supply connections 11 are aligned approximately radially and are constructed so that they are approximately symmetrical and widened in a funnel shape against the outer peripheral wall 17.

This outer peripheral wall 17 is preferably of essentially cylindrical construction, which permits a particularly good distribution of the air which is delivered. However, if required, it is also possible for this outer peripheral wall 17 or at least its upper end to be constructed with a polygonal cross-section for better adaptation to the lower end of the upper force-conducting housing part 12.

In addition a ring of air ducting elements 20 which are arranged approximately in the outer peripheral region of the grinding track 1 can be provided on the inner peripheral side of the outer peripheral wall 17 in a manner which is known per se.

Furthermore, in FIG. 1 it is indicted in solid lines that the air-ducting housing part 13 can be supported by the force-conducting frame 16 of the force-conducting housing part 12, whilst the upper end of the outer peripheral wall 17 is screwed for example like a flange onto the underside of the force-conducting frame 16.

Possibilities also exist for connecting the upper end of the outer peripheral wall 17 of the air-ducting housing part 13 tightly to the lower end of the force-conducting frame 16 and for this air-ducting housing part 13 to be supported only partially by this frame 16, whilst the air-ducting housing part 13 is otherwise supported by the supports 14 and/or the foundation 15. This latter can be achieved for example in the manner shown in FIG. 1 by dash-dot lines, that is to say for example by means of bracket 21 suitably constructed on the supports 14 and/or by means of separate bearing supports 22, in which case the brackets 21 engage in the region of the base plate 19 and optionally the peripheral wall 17 of the air-ducting housing part 13, whilst the bearing supports 22 support the air-ducting housing part 13 in the region of the base plate 19 on the foundation 15 and are arranged so that they are distributed in the peripheral direction below this base plate 19.

Finally, it should also be mentioned that the grinding plate 3 is driven in a manner which is known per se by a gear unit 23 mounted on the foundation 15, whilst this grinding plate 3 is mounted so as to be fixed relative to on a rotatable gear part which is provided coaxially below it.

By means of the construction of the roller mill as described above considerable cost savings can be achieved by contrast with known roller mills with mill housings mounted in the usual way merely because the mill housing can be produced with considerably less material because it is designed to be adapted to the flux of force. Because the mill housing of this roller mill according to the invention is constructed in at least two parts it can be installed particularly easily, particularly in the region of the mill housing. If one considers an entire series of mills, then a large number of models can be produced with a relatively small number of force-conducting housing parts or force-conducting frames. The special adaptation to the particular type or size of mill can be achieved with the aid of the air-ducting housing part, i.e. with such a modular construction one and the same size of force-conducting housing part can be connected to different sizes of air-ducting housing parts.

I claim:

1. A roller grinding mill comprising rotatable grinding means; mounting means for mounting said grinding means on a foundation; an air-ducting housing encircling said grinding means and forming an air-ducting chamber at a level below that of said grinding means; air supply means communicating with said air-ducting chamber for delivering a stream of air into said air-ducting chamber; a force-conducting housing overlying and communicating with air-ducting chamber; support means for supporting said force-conducting housing on said foundation independently of said mounting means; and force reaction means interconnecting said grinding means and said force-conducting housing for absorbing horizontal grinding reaction forces generated by said grinding means.

2. Apparatus as set forth in claim 1 wherein said support means includes a pillar extending upwardly from said foundation.

3. Apparatus as set forth in claim 2 wherein said support means includes a ledge formed along an upper edge of said pillar.

4. Apparatus as set forth in claim 2 wherein said force-conducting housing includes a flange-like portion seated on said pillar.

5. Apparatus as set forth in claim 1 wherein said mounting means includes a driven gear unit mounted on said foundation.

6. Apparatus as set forth in claim 5 wherein said force-conducting housing has a vertical axis and wherein said grinder means has an annular grinder track disposed within said force-conducting housing concentrically about said axis.

7. Apparatus as set forth in claim 6 wherein said grinder track is supported at a level above said gear unit.

8. Apparatus as set forth in claim 6 wherein said grinder means includes a roller element rotatably engaging said grinder track.

9. Apparatus as set forth in claim 6 wherein said grinder track has a dish-shaped upper face rotatable about said vertical axis.

10. Apparatus as set forth in claim 9 wherein said force reaction means includes at least one stationary vertical guide carried by said force-conducting housing for receiving a guide pin operatively coupled to said roller element.

11. Apparatus as set forth in claim 10 wherein said support means is disposed generally in a horizontal plane intersecting said guide pin.

12. Apparatus as set forth in claim 1 wherein said air-ducting housing has an upper end fastened to said force-conducting frame.

13. Apparatus as set forth in claim 12 wherein said upper end of said air-ducting housing is fastened contiguous to said force-conducting frame and said support means has a plurality of bearing supports distributed below said air-ducting housing.

14. Apparatus as set forth in claim 1 wherein said force reaction means comprises pins accommodated in slots, said slots precluding horizontal movement of said grinding means but enabling vertical movement of said grinding means.

* * * * *

UNITED STATES PATENT AND TRADEMARK OFFICE

CERTIFICATE OF CORRECTION

PATENT NO. : 5,100,068

DATED : March 31, 1992

INVENTOR(S) : Herbert Pingel

It is certified that error appears in the above-identified patent and that said Letters Patent is hereby corrected as shown below:

Column 2, line 51, change "particularly" to -- particular --.

Column 4, line 31, change "on" to -- upon --.

Column 5, line 10, change "indicted" to -- indicated --; line 25, change "bracket" to -- brackets --; line 38, cancel "on".

Column 6, line 7, after "with" insert -- said --.

Signed and Sealed this

Twenty-first Day of September, 1993

Bruce Lehman

*Attest:*

BRUCE LEHMAN

*Attesting Officer*

*Commissioner of Patents and Trademarks*